United States Patent [19]

Hayakawa

[11] Patent Number: 4,883,748

[45] Date of Patent: Nov. 28, 1989

[54] NEGATIVE SILVER HALIDE PHOTOGRAPHIC EMULSION

[75] Inventor: Toshiaki Hayakawa, Shizuoka, Japan

[73] Assignee: Fuji Photo Film Co., Ltd., Kanagawa, Japan

[21] Appl. No.: 282,094

[22] Filed: Dec. 9, 1988

[30] Foreign Application Priority Data

Dec. 9, 1987 [JP] Japan ..... 62-311419

[51] Int. Cl.[4] ..... G03C 1/02

[52] U.S. Cl. ..... 430/567; 430/568

[58] Field of Search ..... 430/567, 568

[56] References Cited

U.S. PATENT DOCUMENTS 4,585,729 4/1986 Sugimoto et al. ..... 430/567
4,623,612 11/1986 Nishikawa et al. ..... 430/567
4,806,461 2/1989 Ikeda et al. ..... 430/567

FOREIGN PATENT DOCUMENTS 196541 11/1983 Japan .
261741 11/1986 Japan .

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A negative silver halide photographic emulsion comprising silver halide grains dispersed in a binder, the silver halide grains having the ratio of diameter to thickness of 5.0 or less, the grains further having an internal portion corresponding to half the volume of the silver halide grains and a surface portion corresponding to half the volume of the silver halide grains, wherein the average iodine content in the internal portion is less than 1 mol %, and wherein the average iodine content in the surface portion of the grains is 1 to 4 mol % higher than the average iodine content of the internal portion of the grains.

10 Claims, 1 Drawing Sheet

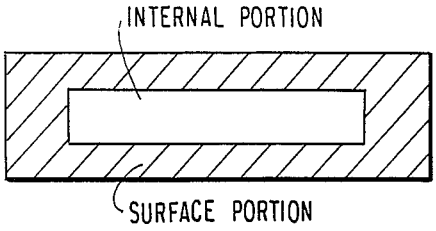
INTERNAL PORTION
SURFACE PORTION

NEGATIVE SILVER HALIDE PHOTOGRAPHIC EMULSION

FIELD OF THE INVENTION

The present invention relates to a negative silver halide photographic emulsion, and more particularly to a negative silver halide emulsion which exhibits high gradation, even under X-ray exposure or high intensity exposure.

BACKGROUND OF THE INVENTION

One of the basic properties of a photographic light-sensitive material comprising a silver halide emulsion coated on a support is that the developed silver density varies in relation to the change in exposure, i.e., the property of gradation. This property is important particularly where it is necessary to recognize fine defects, e.g., in the case of X-ray photography. Examples of a process for improving gradation include a method as disclosed in U.S. Pat. No. 3,574,628 which comprises use of a monodisperse emulsion or a development fog inhibitor such as an azole. However, an emulsion which has been subjected to such a process to adjust gradation is disadvantageous in that when it is subjected to X-ray exposure or high intensity exposure using a screen other than a fluorescent screen, the gradation thereof itself is lowered.

X-ray direct exposure is used for dental X-ray film, mammographic X-ray film, and industrial X-ray film. For high intensity exposure, laser exposure and the like may be used.

Particularly, the gradation property in an industrial X-ray film has much to do with the degree of defect recognition. For example, in the case of detection of defects in a heavy metal system, increasing the film contrast is the only way to improve the recognition degree, because the contrast of the imaged object is too low.

It has also been known that the iodine content may be increased to improve the efficiency of absorption of radiation. However, a high iodine content silver halide grain normally has a low developability, making it difficult to provide an emulsion having a high gradation.

On the other hand, JP-A-53-22408 (the term "JP-A" as used herein refers to a "published unexamined Japanese patent application"), JP-B-43-13162 (the term "JP-B" as used herein refers to an "examined Japanese patent publication"), and *J. Photo. Sci.*, 24, 198 (1976) describe that a laminated type silver halide grain comprising a core covered with a plurality of shells may be used to improve developability or provide a higher sensitivity.

However, silver halide grains prepared for these purposes do not always give an improvement in gradation under X-ray exposure or high intensity exposure. For example, JP-A-53-22408 describes a laminated type silver halide grain comprising a pure silver bromide (core)/silver iodobromide (iodine content: 1 mol %)/pure silver bromide structure. This silver halide grain provides a lower gradation at X-ray exposure or high intensity exposure rather than improving the gradation.

Silver halide grains comprising a coating layer obtained by halogen substitution are described in West German Patent 2,932,650, and JP-A-51-2417, JP-A-51-17436, and JP-A-52-11927. However, these silver halide grains are disadvantageous in that even though they may improve the fixing rate, they may cause development inhibition, making it impossible to provide a desired sensitivity. Therefore, these silver halide grains cannot be put into practical use to provide a negative emulsion having desired gradation.

Positive (internal latent image type) silver halide grains comprising a core covered with a plurality of coating layers by halogen substitution have been known. Such positive silver halide grains are described in detail in U.S. Pat. Nos. 2,592,250 and 4,075,020 and JP-A-55-l27549. These silver halide grains are often used for diffusion transfer internal latent image type direct positive light-sensitive materials. However, since these silver halide grains have too high an internal sensitivity, they can never be used for negative emulsions suitable for exposure of the type to which the present invention is applied.

An approach which comprises sensitizing the surface of silver halide grains is described in West German Patent 2,932,650. However, even such silver halide grains cannot provide an gradation at X-ray exposure or high intensity exposure.

JP-A-55-l27549 describes a silver halide emulsion containing grains comprising a core containing almost 100% silver iodide, covered with silver iodobromide. Such a core composition i obtained by replacing chlorine with bromine and bromine with iodine. However, such a silver halide emulsion is disadvantageous in that it is very susceptible to pressure desensitization, making it unsuitable for practical use. Even if such a silver halide emulsion is sensitized on the surface of the grains so that it is converted to a negative emulsion, it is still subject to pressure desensitization and cannot provide in improved gradation, making it unsuitable for practical use.

SUMMARY OF THE INVENTION

It is therefore, an object of the present invention to provide a silver halide emulsion which overcomes the above-described problems and exhibits a high gradation.

The above-described and other objects of the present invention will become more apparent from the following detailed description and examples These objects of the present invention are accomplished with a negative silver halide photographic emulsion comprising silver handle rains dispersed in a binder, the silver halide grains having the ratio of diameter to thickness of 5.0 or less, the grains further having an internal portion corresponding to half the volume of the silver halide grains and a surface portion corresponding to half the volume of the silver halide grains, wherein the average iodine content in the internal portion is less than 1 mol %, and wherein the average iodine content in the surface portion of the grains is 1 to 4 mol% higher than ne average iodine content of the internal portion of the grains. Hereafter, all mol% is based on th amount of silver.

BRIEF DESCRIPTION OF THE DRAWING

The accompanying drawing is a cross section view to show the silver halide grain of the present invention.

DETAILED DESCRIPTION OF THE INVENTION

The silver halide grains to be employed in the present silver halide photographic emulsion are characterized in that the ratio of the grain diameter to the grain thickness thereof is 5.0 or less, particularly 1.0 to 3.0.

The term grain diameter as used herein means the diameter of a circle having th same area as the projected area of the grain.

The silver halide grains are further characterized in that the average iodine content in the silver halide in the internal portion of one grain differs from the average iodine content in the outside portion of the grain (hereinafter the "surface potion"). (See accompanying drawing.)

Particularly, the average iodine content in the silver halide in the surface portion of the grain is preferably in the range of 1.0 to 0 mol %, more preferably 1 to 2 mol %, based on the amount of silver. The average iodine content in the silver halide in the internal portion of the silver halide grains is less than 1 mol %, and preferably 0 to 0.5 mol %, based on the amount of silver.

The iodine distribution in the present silver halide grain may be uniform or local or may gradually change (e.g., from the internal portion toward the surface thereof) in the internal portion and the surface portion of the grain as defined below.

One of the features of the present invention is that the average iodine content in the internal portion and the surface portion of the grains as defined below satisfies the relationship as described above regardless of how iodine is distributed in the grain.

The term "internal portion" as used herein means a portion having a configuration similar to that of the whole grain and which accounts for ½ of the volume of the grain. Specifically, the internal portion can be determined by etching the surface of the silver halide grain with a solvent until the volume of the grain is reduced to ½ of the original value. The "surface" portion is that portion outside the "internal" portion.

Therefore, the average iodine content in the internal portion and the surface portion in the present invention can be determined by comparing the average iodine content in the whole grain before being etched to that of the grain after being etched.

Particularly, the measurement of the average iodine content can be accomplished by the EPMA process known in the art.

The EPMA process is described in detail in Takayoshi Fukushima, *Electron Ray Microanalysis,* February, 1987, Nikkan Kogyo Shinbunsha.

The silver halide grain which is used in the present invention may have a so-called core/shell structure.

In such a core/shell structure, the boundary between the core and the shell may be definite as described in JP-A-62-6248 or may be indefinite.

If such a core/shell structure is used, the silver molar proportion of core to shell can be optionally selected but is normally in the range of 1/9 to 9/1, preferably 3/7 to 7/3, and particularly preferably 4/6 to 6/4.

The silver halide grains of the present invention may have a multiple layer structure as described in JP-A-60-35726.

As the present silver halide grains, there may be used silver halide grains wherein the iodine distribution gradually changes from the internal portion toward the surface thereof.

The grain size distribution of the silver halide grains may be of any type, but is preferably monodisperse.

The term "monodisperse system" as used herein means a disperse system wherein 95% of the grains fall within ±60%, preferably ±40%, of the number average grain diameter. The number average grain diameter is the average of the diameters of the projected areas of the grains.

The proportion of the silver halide grains of the present invention based on the total silver halide grains in the emulsion may be optionally selected, but is preferably 40% or more, particularly 60% or more, as calculated in terms of the molar amount of silver.

The grain diameter is an important factor for the sensitivity of the light-sensitive material, and a light-sensitive material of large sized grain emulsion has high sensitivity which is preferable for practical use. Therefore, the number average grain diameter of the silver halide grains of the present photographic emulsion is preferably at least 0.2 μm, and more preferably at least 0 3 μm.

On the other hand, as is well known in the photographic art, the use of silver halide grains having a large grain diameter may decrease the handling properties of film since the pressure desensitization and pressure fog are liable to occur. Therefore, the upper limit of the number average grain diameter is preferably 5 μm, more preferably 1 μm.

Examples of processes which may be used for preparation of the present silver halide grains will be described hereinafter.

Particularly, the preparation of the silver halide grains can be accomplished by a process which comprises forming a core made of silver bromide, silver iodobromide or silver iodochlorobromide (iodine content: less than 1 mol %), and providing a coating layer comprising silver iodobromide or silver iodochlorobromide (iodine content: higher than that of the core by 1 mol % or more) on the core to prepare a double layer silver halide grain, and wherein the silver content in the core is 10 to 90 mol % of the whole silver halide grain.

The preparation of the present silver halide emulsion will be further described hereinafter.

The preparation of the core of the silver halide grains of the present invention can be accomplished by any suitable method as described in P. Glafkides, *Chimie et Physique Photoqrahique,* Paul Montel, 1967, G. F. Duffin, *Photographic Emulsion Chemistry,* The Focal Press, 1966, and V. L. Zelikman et al., *Making and Coating Photograhic Emulsion,* The Focal Press, 1964. Particularly, the preparation of the silver halide photographic emulsion can be accomplished by any one of an acid process, a neutral process and an ammonia process.

In preparing the core silver halide grains, a soluble silver salt is reacted with a soluble silver halide. The process for the reaction of the soluble silver salt with the soluble silver halide can be accomplished by a single jet method, a double jet method, or a combination thereof. The process for the reaction of the soluble silver salt with the soluble silver halide also can be accomplished by a process in which grains are formed in excess silver ions (a so-called reverse mixing method). One form of the double jet method is a so-called controlled double jet method in which the pAg of the liquid phase in which silver halide is formed is kept constant. This method can provide a silver halide emulsion having a regular crystal structure and a nearly uniform grain size.

Two or more silver halide emulsions which have been separately prepared may be mixed before use.

In the preparation of the core of the present silver halide grains, the halogen composition of the silver halide to be used is preferably uniform. If the core of the silver halide grains consists of silver iodobromide, the double jet method or controlled double jet method may be preferably used. If the core consists of silver bromide, the single jet method is preferably used.

The pAg value at which the core of the silver halide grains is prepared depends on the reaction temperature and the kind of the silver halide solvent, but is preferably in the range of 7 to 11. A silver halide solvent may be preferably used to minimize the time for the formation of the silver halide grains. For example, commonly known silver halide solvents such as ammonia and thioether may be used in the present invention The shape of the core of the silver halide grains may be plate, cube, twin, octahedron, sphere, tetradecahedron, or a composite thereof.

The core of the silver halide grains may be monodisperse or polydisperse, and is preferably monodisperse.

Silver halide grains having a uniform grain size can be prepared by a process as described in British Patent 1,535,016, and JP-B-48-36890 and JP-B-52-l6364 which comprises changing the rate at which silver nitrate or an aqueous solution of halogenated alkali is added depending on the rate at which the grains grow, or by a process as described in U.S. Pat. No. 4,242,445, and JP-A-55-158124 which comprises changing the concentration of an aqueous solution so that grains can grow at a high rate within the critical supersaturation degree. By these processes, silver halide grains can each be uniformly coated without causing renucleation. These processes can be preferably used to incorporate the grain coating layer onto the grain core, as described later The process for introducing the coating layer into the core of silver halide grain is described in JP-A-60-35726, JP-A-55-l27549, and U.S. Pat. Nos. 2,592,250 and 4,075,020.

When the coating layer is incorporated, the change in the critical supersatuation degree needs to be considered because the coating layer differs from the core in halogen composition and therefore hardly precipitates on the surface of the core. The molar number of the silver nitrate to be added per unit time (sec) is preferably increased as the total surface area of the grains increases.

The halogen composition of the coating layer is preferably uniform. To this end, if the coating layer consists of silver iodobromide, the coating layer is preferably formed by the double jet method or the controlled double jet method.

The iodine content of the coating layer of the present silver halide grains can be determined by any suitable method as described in J. I. Goldstein and D. B. Williams, *X-Ray Analysis in TEM/ATEM,* Scanning Electron Microscopy, Vol. 1 (IIT Research Institute), page 651, March, 1977.

If it is necessary to change the iodine content gradually , a KI solution may be simultaneously added to the system in changing amounts for preparing the core.

In the preparation of the present silver halide grains, the removal of soluble salts from an emulsion which has been subjected to physical ripening or optionally an emulsion in which the core has been formed can be accomplished by the noodle rinse process in which gelatin is gelated, or the sedimentation (flocculation) process using an inorganic salt, an anionic surface active agent, an anionic polymer (e.g., polystyrenesulfonic acid), or a gelatin derivative (e.g., acylated gelatin, carbamoylated gelatin).

The grains of the silver halide emulsion are normally subjected to chemical sensitization on the surface of the grains. Chemical sensitization can be accomplished by any suitable method as described, for example, in H. Frieser, *Die Grundlaqen der Photorahischen Prozesse mit Silberhalogeniden,* Akademische Verlagsgesellschaft, 1968, pp. 675–734.

Particularly, a sulfur sensitization process using a sulfur-containing compound capable of reacting with a silver ion or active gelatin, a reduction sensitization process using a reducing substance, or a noble metal sensitization process using gold or other noble metal compounds may be used, either singly or in combination. As sulfur sensitizing agents there may be used thiosulfates, thioureas, thiazoles, rhodanines, and the like. As reduction sensitizing agents there may be used stannous salts, amines, hydrazine derivatives, formamidinesulfinic acid, silane compounds, and the like. For the noble metal sensitization process, complexes of the group VIII metals such as platinum,, iridium, and palladium may be used besides gold complexes.

The silver halide grains may be subjected to these chemical sensitization processes in combination.

The coated amount of silver may be varied but is preferably in the range of 1,000 to 15,000 mg/m$^2$, particularly 2,000 to 10,000 mg/m$^2$.

A light-sensitive layer comprising the silver halide grains may be provided on both sides of the support.

As a binder or protective colloid for the photographic emulsion there may be advantageously used gelatin. Other hydrophilic colloids may be used.

Examples of such hydrophilic colloids include protein such as a gelatin derivative, a graft polymer of gelatin with other high molecular weight compounds, albumin, and casein, cellulose derivatives such as hydroxyethyl cellulose, carboxymethyl cellulose, and cellulose ester sulfate, saccharide derivatives such as sodium alginate, and starch derivatives, monopolymers or copolymers such as polyvinyl alcohol, polyvinyl alcohol partial acetal, poly-N-vinylpyrrolidone, polyacrylic acid, polymethacrylic acid, polyacrylamide, polyvinyl imidazole, and polyvinyl pyrazole, and other various synthetic hydrophilic high molecular weight compounds.

As gelatin there may be used acid-treated gelatin or enzyme-treated gelatin as described in *Bull. Soc. Sci. Phot., Japan, No.* 16, page 30, 1966, or lime-treated gelatin. Alternatively, hydrolyzate or enzymatic decomposition products of gelatin may be used. As gelatin derivatives there may be used products of the reaction of gelatin with various compounds such as acid halide, acid anhydride, isocyanate, bromoacetic acid, alkane sultones, vinylsulfonamides, maleinimide compounds, polyalkylene oxides, and epoxy compounds.

For the purpose of inhibiting fog during the preparation, preservation or photographic processing of the light-sensitive material or to stabilize the photographic properties of the light-sensitive material, the present photographic emulsion may comprise various additive compounds. Examples of such compounds include any of the compounds known as fog inhibitors or stabilizers such as azoles [e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole)], mercaptopyrimidines, mercaptotriazines, thioketo compounds (e.g., oxazolinethione), azaindenes [e.g., triazaindenes, tetraazaindenes (particularly, 4-hydroxy-substituted (1,3,3a,7)tetraazaindenes), pentaazaindenes], benzenethiosulfonic acid, benzenesulfinic acid, and benzenesulfonic acid amide.

The photographic emulsion layer or other hydrophilic colloidal layers in the light-sensitive material comprising the present photographic emulsion may comprise various surface active agents for various purposes such as aiding coating, inhibiting static charge, emulsion dispersion or adhesion, or improving sliding properties or photographic properties (e.g., acceleration of development, provision of higher contrast, sensitization).

Examples of such surface active agents include nonionic surface active agents such as saponin (steroid series), alkylene oxide derivatives (e.g., polyethylene glycol, polyethylene glycol/polypropylene glycol condensate, polyethylene glycol alkyl ether or polyethylene glycol alkyl aryl ether, polyethylene glycol ester, polyethylene glycol sorbitan ester, polyalkylene glycol alkylamine or amide, polyethylene oxide addition product of silicone), glycidol derivatives (e.g., polyglyceride alkenylsuccinate, alkylphenol polyglyceride), fatty acid ester of polyhydric alcohol, and alkyl ester of saccharide; anionic surface active agents containing acidic groups such as a carboxy group, a sulfo group, a phospho group, a sulfuric ester group, a phosphoric ester group (e.g., alkylcarboxylate, alkylsulfonate, alkylbenzenesulfonate, alkylnaphthalenesulfonate, alkylsulfuric acid ester, alkylphosphoric acid ester, N-acyl-N-alkyltaurine, sulfosuccinic acid ester, sulfoalkyl polyoxyethylene alkylphenyl ether, polyoxyethylene alkylphosphoric acid ester; amphoteric surface active agents such as amino acids, aminoalkylsulfonic acids, aminoalkylsulfuric or aminoalkylphosphoric esters, alkylbetaines, and amine oxides; and cationic surface active agents such as alkylamine salts, aliphatic or aromatic tertiary ammonium salts, heterocyclic quaternary ammonium salts (e.g., pyridinium, imidazolium), and phosphonium or sulfonium salts containing an aliphatic group or a heterocyclic group.

The present photographic emulsion may be spectrally sensitized with a methine dye or the like. These dyes may be used singly or in combination. A combination of sensitizing dyes is often used particularly for the purpose of supersensitization. The present emulsion may comprise a dye which itself has no spectral sensitizing effect or a substance which substantially does not absorb visible light but exhibits a supersensitizing effect in combination with such a sensitizing dye.

Combinations of useful sensitizing dyes and dyes which exhibit a supersensitizing effect and substances which exhibit a supersensitizing effect are described in *Research Disclosure,* No. 17643, December, 1978, page 23, IV-J.

The photographic light-sensitive material comprising the present photographic emulsion may contain an inorganic or organic hardener in the photographic emulsion layer or other hydrophilic colloidal layers. Examples of such a hardener include chromium salts (e.g., chrome alum), aldehydes (e.g., formaldehyde, glutaraldehyde), N-methylol compounds (e.g., dimethylolurea), dioxane derivatives (e.g., 2,3-dihydroxydioxane), active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine), and mucohalogenic acids (e.g., mucochloric acid). These compounds may be used singly or in combination.

The photographic light-sensitive material comprising the present photographic emulsion may contain a dispersion of a water-insoluble or sparingly water-soluble synthetic polymer in the photographic emulsion layer or other hydrophilic colloidal layers for the purpose of improving the dimensional stability. Examples of such polymers which may be used include polymers containing as monomer components alkyl (meth)acrylate, alkoxyalkyl (meth)acrylate, glycidyl (meth)acrylate, (meth)acrylamide, vinyl ester (e.g., vinyl acetate), acrylonitrile, olefin, styrene, or combinations thereof, or combinations thereof with acrylic acid, methacrylic acid, $\alpha,\beta$-unsaturated dicarboxylic acid, hydroxyalkyl (meth)acrylate, sulfoalkyl (meth)acrylate, or styrenesulfonic acid.

In the present photographic light-sensitive material, the photographic emulsion layer or other hydrophilic layers can be prepared by coating on a support or other layers by various known methods. Examples of suitable coating processes which can be used include a dip coating process, a roller coating process, a curtain coating process, and an extrusion coating process. Processes as described in U.S. Pat. Nos. 2,681,294, 2,761,791 and 3,526,528 are useful. As a suitable support there may be used cellulose ester film such as cellulose triacetate film, polyester film such as polyethylene terephthalate film, or $\alpha$-olefinic polymercoated paper.

The application of the present silver halide emulsion is not limited to direct or indirect X-ray-sensitive material, lith light-sensitive material, black-and-white light-sensitive material for photographing use, or other black-and-white light-sensitive materials. The present silver halide emulsion can be applied to color negative light-sensitive material, color reversal light-sensitive material, color paper or color light-sensitive materials.

The photographic processing of the present light-sensitive material can be accomplished by any suitable known method and with any suitable known processing solution as described, for example, in *Research Disclosure,* No. 17643, December, 1978, pp. 28 to 30. The photographic processing may consist of photographic processing for formation of silver images (black-and-white processing) or photographic processing for formation of dye images (color photographic processing) depending on the purpose of application. The processing temperature is normally selected between 18° C. and 50° C. but may be lower than 18° C. or higher than 50° C.

The developing solution to be used for black-and-white processing may contain a known developing agent. Examples of such a known developing agent include dihydroxybenzenes (e.g., hydroquinone), 3-pyrazolidones (e.g., 1-phenyl-3-pyrazolidone), and aminophenols (e.g., N-methyl-p-aminophenol). These compounds may be used singly or in combination. The developing solution may also comprise a known preservative, an alkaline agent, a pH buffer, a fog inhibitor or the like. The developing solution may optionally further comprise a dissolution aid, a toning agent, a development accelerator, a surface active agent, a defoaming agent, a hard water softener, a hardener, a viscosity imparting agent or the like.

As a fixing solution there may be used a composition commonly used as a fixing solution.

As a fixing agent there may be used thiosulfate, thiocyanate, or organic sulfur compounds known to have a fixing effect.

The fixing solution may contain a water-soluble aluminum salt as a hardener.

The present invention will be further described in the following examples, but the present invention should not be construed as being limited thereto.

EXAMPLE 1

[1] Preparation of Comparative Specimen I-1

Preparation of Silver Bromide Grains 30 g of gelatin, 1.7 g of potassium bromide and 4 cc of 5% 3,6-dithia-l,8-octanediol were added to 1.1 liters of water to obtain a first aqueous solution. 576 ml of an aqueous solution containing silver nitrate in an amount of 417 g per liter (Solution A) and 564 ml of an aqueous solution containing potassium bromide in an amount of 300 g per liter (Solution B) were simultaneously added, to the first aqueous solution in a container which was kept at a temperature of 75° C. by a double jet method over a period of 55 minutes with stirring while the pBr value thereof was kept at 2.0. Thus, an emulsion of tetradecahedron silver bromide grains having a size of 0.77 m or less as calculated in terms of the diameter of the projected area was obtained.

The silver halide emulsion thus obtained was then subjected to chemical ripening with $2\times10^{-4}$ mol of 1-phenyl-5-mercaptotetrazole, 2.3 mg of chloroauric acid, 0.33 mg of potassium thiocyanate, and 3.4 mg of sodium thiosulfate at a temperature of 55° C. for 40 minutes. 730 mg of 4-hydroxy-6-methyl-1,3,3a,7-tetraazaindene was added to the emulsion. A coating aid was then added to the emulsion.

The emulsion was then coated on a PET (polyethylene terephthalate) support simultaneously with a protective layer of the following composition in an amount of 8 g/m$^2$ as calculated in terms of the amount of silver to prepare Comparative Specimen I-1.

Protective Layer:

Gelatin layer having a dried film thickness of 1.2 μm containing a bis type polyethylene oxide compound, a fluorine-containing hydrocarbon surface active agent, a hydrocarbon anionic coating aid particulate polymethyl methacrylate as a matting agent, colloidal silica as a lubricant and 2,4-dichloro-6-hydroxy-s-triazine as a hardener.

[2] Preparation of Comparative Specimens I-2 to I-5

Preparation of Silver Iodobromide Grains

Comparative Specimens I-2 to I-5 were prepared in the same manner as in Comparative Specimen I-1 except that KI was added to Solution B in amounts of 4.3 g, 8.5 g, 12.8 g and 17 g, respectively.

[3] Preparation of Comparative Specimen I-6

Preparation of Cores

The preparation of cores was conducted in the same manner as in Comparative Specimen I-4 except that Solution A and Solution B were used only in amounts of 288 ml and 282 ml, respectively. The silver halide grains thus obtained contained tetradecahedron silver halide grains having a size of 0.61 μm and 3 mol % of iodine.

Preparation of Grain Coating Layer

A pure AgBr coating layer was coated on the cores thus obtained with Solution B (free of KI) in the same manner as used in the foregoing specimens. The silver halide grains thus obtained contained tetradecahedron grains having a size of 0.77 μm and a total iodine content of 1.5 mol %. The emulsion was then subjected to post-ripening and the subsequent processing in the same manner as in I-1.

[4] Preparation of Present Silver Halide Grains I-7 to I-10 and Comparative Silver Halide Grains I-11

Preparation of Cores

The preparation of cores was conducted in the same manner as in Comparative Specimen I-6 except that Solution B free of KI was used. Thus, tetradecahedron silver bromide grains having a size of 0.61 μm as calculated in terms of diameter of sphere having the same area as projected area was obtained.

Preparation of Grain Coating Layer

Specimens I-7 to I-10 according to the present invention, and Comparative Specimen I-11 were then prepared in the same manner as in the preparation of Comparative Specimen I-6, except that KI was added to Solution B in amounts of 4.3 g, 8.5 g, 12.8 g, 17 g and 21.5 g, respectively. Specimens I-7 to I-11 contained tetradecahedron silver halide grains having a size of 0.77 μm and a total iodine content of 0.5 mol %, 1 mol %, 1.5 mol % and 2.5 mol %, respectively.

[5] Preparation of Silver Halide Grains I-12 According to the Present Invention ad Comparative Silver Halide Grains I-13

The preparation of cores was effected in the same manner as in the preparation of Comparative Specimen I-6, except that KI was added to Solution B in amounts of 2.1 g (Specimen I-12) and 4.3 g (Comparative Specimen I-13), respectively. A coating layer was provided on these cores in the same manner as in [4] above, except that KI was incorporated in Solution B in an amount of 8.5 g. Thus, tetradecahedron silver halide grains having a size of 0.77 μm and total iodine contents of 1.25 (Specimen I-12) and 1.5 (Comparative Specimen I-13) mol %, respectively, were obtained.

[6] Evaluation of X-Ray Gradation and Gradation at High Intensity Exposure

X-Ray Exposure

X-ray was emitted at an acceleration voltage of 100 kV and a current of 9 mA. A direct exposure was effected, and exposure time was varied.

High Intensity Exposure

A xenon discharge tube was used as flash light source. The high intensity exposure was effected at a half-life period of $10^{-6}$ second.

Recognition Evaluation by $Co^{60}$

The emulsions obtained in [1] to [5] were each coated on both sides of PET support. The specimens were put into a nonscreen cassette for shielding which does not have a fluorescent substance and lead. An ASME recognition degree meter #10 was placed on the nonscreen cassette. An X-ray was emitted at an acceleration voltage of 100 kV and a current 9 mA at the cassette. The exposure time was varied so that the density on the film reached 2.5. The films thus processed were then checked for recognition at 1T, 2T, and 4T according to ASME (o: recognizable, Δ: slightly recognizable, x: unrecognizable). It was determined that the recognition degree was greater in the order of $4T^x$, $4T^\Delta$, $4T^\circ$, $2T^\Delta$, $2T^\circ$, $1T^\Delta$, and $1T^\circ$. The smallest hole could be recognized. The results are shown in Tables 1 and 2.

The specimens which had been thus exposed were then processed with Fuji HiRendol developing solution at a temperature of 20° C. for 3 minutes. These specimens were then fixed with Fuji Fix fixing solution at a temperature of 20° C. for 3 minutes. These specimens were rinsed and dried. The gradation was determined by the gradient of the straight line between the point of 0.75 and the point of 1.75 on the fog density as optical density (abscissa indicates log of exposure). The sensitivity was indicated as a relative value in each specimen, taking that of Specimen I-1 to be 100.

Specifically, the sensitivity was determined by the following equation:

$$\frac{to}{tx} \times 100$$

to: exposure time when the optical density of Speciman I-1 was increased by 2.0 from the fog value.

tx: exposure time when the optical density of Speciman X was increased by 2.0 from the fog value.

The results are shown in Table 1.

TABLE 1

| Specimen No. | Internal Iodine Content (mol %) | Surface Iodine Content (mol %) | Sensitivity | Gradation at X-Ray Direct Exposure | Gradation at Exposure for $10^{-6}$ Sec | Recognition Degree of Both Sides-Coated Specimen by ASME #10 (X-ray direct exposure) |
|---|---|---|---|---|---|---|
| I-1 (Comparison) | 0 | 0 | 100 | 2.3 | 2.35 | 4T° |
| I-2 (Comparison) | 1 | 1 | 101 | 2.3 | 2.35 | 4T° |
| I-3 (Comparison) | 2 | 2 | 102 | 2.25 | 2.35 | 4T° |
| I-4 (Comparison) | 3 | 3 | 95 | 2.2 | 2.3 | 4T° |
| I-5 (Comparison) | 4 | 4 | 90 | 2.1 | 2.1 | 4T$^{\Delta}$ |
| I-6 (Comparison) | 3 | 0 | 95 | 2.2 | 2.2 | 4T$^{\Delta}$ |
| I-7 (Invention) | 0 | 1 | 102 | (2.5) | (2.6) | 2T° |
| I-8 (Invention) | 0 | 2 | 102 | (2.6) | (2.6) | 2T° |
| I-9 (Invention) | 0 | 3 | 101 | (2.55) | (2.5) | 2T° |
| I-10 (Invention) | 0 | 4 | 99 | (2.5) | 2.4 | 2T° |
| I-11 (Comparison) | 0 | 5 | 95 | 2.2 | 2.2 | 4T$^{\Delta}$ |
| I-12 (Invention) | 0.5 | 2 | 102 | (2.6) | (2.6) | 2T° |
| I-13 (Comparison) | 1 | 2 | 100 | 2.3 | 2.3 | 2T$^{\Delta}$ |

The figures in parenthesis are values in which the average gradation is 2.5 or more.

Table 1 shows that the gradation can exceed 2.4 without impairing the sensitivity simply by using the iodine distribution in the silver halide grains of the present invention. As shown in Table 1, in the recognition degree by ASME #10, 2T can be completely recognized only for the specimens comprising the silver halide grains of the present invention.

EXAMPLE 2

The effect of aspect ratio in the present silver halide grains will be described hereinafter.

[1] Preparation

Silver halide grains having an aspect ratio of 3.1 was prepared by the process described in A. P. H. Trivelli & W. F. Smith, *The Photographic Journal*, pp. 330 to 338, May, 1939. Silver halide grains having an aspect ratio of 10.5 was prepared by the process described in U.S. Pat. No. 4,425,425. Silver halide grains having aspect ratios of 4.4 and 6.5 were prepared by the process described in U.S. Pat. No. 4,425,426.

In the preparation of silver halide grains, the addition of iodine was effected in increasing amounts. More specifically, the added amount of iodine was 0 mol % until the added amount of Ag reached 5 mol % of the ultimate grain. Iodine was then added in increasing amounts by a linear function with time. The added amount of iodine finally reached 3 mol %. In other words, the iodine content was continuously varied from 0 mol % at the center of the grain to 3 mol % at the surface of the grain.

[2] Evaluation

These emulsions were then coated on a support in the same manner as in Comparative Specimen I-1. The specimens thus obtained were then subjected to the same tests as in Example 1. The results are shown in Table 2.

TABLE 2

| Specimen No. | Internal Iodine Content (mol %) | Surface Iodine Content (mol %) | Aspect Ratio | Gradation at X-Ray Exposure | Gradation at Exposure for $10^{-6}$ Sec | Recognition at X-Ray Exposure |
|---|---|---|---|---|---|---|
| II-1 (Invention) | 0.75 | 2.25 | 3.1 | 2.6 | 2.6 | 2T° |
| II-2 (Invention) | 0.75 | 2.25 | 4.4 | 2.5 | 2.55 | 2T° |
| II-3 (Comparison) | 0.75 | 2.25 | 6.5 | 2.3 | 2.35 | 2T$^{\Delta}$ |
| II-4 (Comparison) | 0.75 | 2.25 | 10.5 | 2.0 | 2.1 | 2T$^{\Delta}$ |

Table 2 shows that when the aspect ratio is low as in accordance with the present invention, the recognition degree is high.

When the aspect ratio exceeds 5, the effects of the present invention cannot be substantially expected.

While the invention has been described in detail and with reference to specific embodiments thereof, it will be apparent to one skilled in the art that various changes and modifications can be made therein without departing from the spirit and scope thereof.

What is claimed is:

1. A negative silver halide photographic emulsion comprising silver halide grains dispersed in a binder, said silver halide grains having the ratio of diameter to thickness of 5.0 or less, said grains further having an internal portion corresponding to half the volume of said silver halide grains and a surface portion corresponding to half the volume of said silver halide grains, wherein the average iodine content in the internal portion is less than 1 mol %, and wherein the average iodine content in the surface portion of the grains is 1 to 4 mol % higher than the average iodine content of the internal portion of said grains.

2. A negative silver halide photographic emulsion as in claim 1, wherein the iodine content of the internal portion of said silver halide grains is 0 mol %.

3. A negative silver halide photographic emulsion as in claim 2, wherein the grain diameter to grain thickness ratio is from 1.0 to 3.0.

4. A negative silver halide photographic emulsion as in claim 1, wherein said silver halide grains have a core/shell structure and wherein the silver molar proportion of the core to the shell is in the range of 1/9 to 9/1.

5. A negative silver halide photographic emulsion as in claim 1, wherein the average iodine content in the surface portion of said grains is 1 to 2 mol % higher than that of the average iodine content of the internal portion of said grains.

6. A negative silver halide photographic emulsion as in claim 1, wherein the grain size distribution of said silver halide grains is monodisperse.

7. A negative silver halide photographic emulsion as in claim 1, wherein said silver halide grains are contained in the emulsion in a proportion of 40% or more of the total silver halide grains in terms of the molar amount of silver.

8. A negative silver halide photographic emulsion as in claim 7, wherein said silver halide grains are contained in the emulsion in a proportion of 60% or more of the total silver halide grains in terms of the molar amount of silver.

9. A negative silver halide photographic emulsion as in claim 1, wherein the number average grain diameter of said silver halide grains is 0.2 μm to 5 μm.

10. A negative silver halide photographic emulsion as in claim 9, wherein the number average grain diameter of said silver halide grains is 0.3 μm to 1 μm.

* * * * *